United States Patent [19]

Shikama et al.

[11] Patent Number: 4,831,241

[45] Date of Patent: May 16, 1989

[54] METHOD OF ASSEMBLING CYLINDRICAL HEATER

[75] Inventors: Takashi Shikama; Toshikazu Nakamura; Kiyofumi Torii, all of Yokaichi, Japan

[73] Assignee: Murata Manufacturing Co., Ltd., Japan

[21] Appl. No.: 812,249

[22] Filed: Dec. 23, 1985

[30] Foreign Application Priority Data

Dec. 28, 1984 [JP] Japan ..... 59-279241

[51] Int. Cl.[4] ..... H05B 3/44

[52] U.S. Cl. ..... 219/544; 219/504; 427/58

[58] Field of Search ..... 219/530, 540, 504, 505, 219/544, 222; 328/22 R; 174/DIG. 8; 427/581

[56] References Cited

U.S. PATENT DOCUMENTS 4,426,573 1/1984 Fudickar et al. ..... 219/530
4,493,972 1/1985 Steinel et al. ..... 219/530
4,509,820 4/1985 Murata et al. ..... 219/544

FOREIGN PATENT DOCUMENTS 2076270 12/1981 United Kingdom .

*Primary Examiner*—Joseph W. Hartary
*Assistant Examiner*—Lincoln Donovan
*Attorney, Agent, or Firm*—Ostrolenk, Faber, Gerb & Soffen

[57] ABSTRACT

A method of assembling a cylindrical heater whereby the cylindrical heater includes a positive temperature coefficient thermistor element sandwiched between a pair of terminal members at its opposite electrode surfaces. The thermistor element is inserted into an opening formed in a cylindrical case of a material having heat-shrinkability and thereafter, the cylindrical case is caused to shrink by heating for holding the positive temperature coefficient thermistor element and the terminal members under pressure so as to obtain thermal connection thereof.

5 Claims, 3 Drawing Sheets

METHOD OF ASSEMBLING CYLINDRICAL HEATER

BACKGROUND OF THE INVENTION

The present invention generally relates to a heater and more particularly, to a method of assembling a cylindrical heater employing a positive temperature coefficient thermistor element.

Recently, a positive temperature coefficient thermistor element has been employed in a heater of small size and with high reliability, for example, a cylindrical heater or the like.

Referring first to FIG. 1, there is shown an example of a conventional cylindrical heater H1 having a molded cylindrical case 14 of an insulating material, and a pair of positive temperature coefficient thermistor elements 12 accommodated in the cylindrical case 14 and each provided with a pair of electrodes at its opposite surfaces, with each of the thermistor elements 12 being connectively soldered in parallel relation with each other by a pair of lead wires 16. The above mentioned cylindrical heater H1 is assembled in such a manner that the thermistor elements 12 soldered with the lead wires 16 are inserted into the molded cylindrical case 14 and thereafter, a material having excellent thermal conductivity and superior electrical insulating characteristics is filled in a space defined by the cylindrical case 14, the thermistor elements 12 and the lead wires 16.

In FIGS. 2*a* and 2*b*, there is illustrated another example of a conventional cylndrical heater H2 comprising a cylndrical case 14*a*, a positive temperature coefficient thermistor element 12*a* sandwiched between a pair of terminal strips (not shown) and a pair of elastic heat sinks 17 each having a cross section of a semi-circular shape. The cylindrical heater H2 of the above described type is assembled employing a method wherein an inner assembly is firstly formed in a shape like a rectangular flat plate by wrapping the thermistor element 12*a* held between a pair of terminal strips into an insulating film 15 and is subsequently inserted into the cylindrical case 14*a*, with the pair of heat sinks 17 being held therebetween.

There is shown in FIGS. 3*a* and 3*b*, a further example of a conventional cylindrical heater H3 having a cylindrical case 14*b* composed of an elastomer with insulating characteristics and superior thermal conductivity, and a positive temperature coefficient thermistor element 12*b* held between a pair of terminal strips 18. FIG. 4*a* shows a cross sectionof the cylindrical case 14*b* of the cylindrical heater H3 ad FIG. 4*b* shows a cross section of an inner assembly of the cylndrical heater H3 wherein the thermistor element 12*b* is sandwiched between a pair of terminal strips 18. The cylindrical heater H3 of the above described type is assembled by a method wherein the inner assembly is forcibly inserted into an opening 19 formed in the cylindrical case 14*b* and having a rectangular cross section as shown in FIG. 4*a*. In this example, an inner short side length D1 of the opening 19 is smaller than a total thickness D2 of the inenr assembly at a stage before insertion of the inner assembly into the cylndrical case 14*b*, and the positive temperature coefficient thermistor element 12*b* and a pair of terminal strips 18 are applied with pressure to each other under the influence of elasticity of the cylindrical case 14*b* after insertion of the inner assembly into the cylindrical case 14*b*.

However, in the assembling method as explained with reference to FIG. 1, since the positive temperature coefficient thermistor elements 12 are directly soldered to the lead wires 16, the assembly steps are complex and have the drawback that the thermistor elements 12 are exposed to be deteriorated by heat when being soldered with the lead wires 16. Furthermore, since a filler is completely filled in a space around the thermistor elements 12, there has been another drawback that the thermistor elements 12 are exposed to be deteriorated in quality thereof under the influence of lack of oxygen. In addition, the cylindrical heaters H1 have been manufactured undesirably at high cost, since a time consuming assembling work is required for ensuring reliability of products.

Meanwhile, in the assembling method as stated with reference to FIGS. 2*a* and 2*b*, there has been a disadvantage related to high production cost, since an increased number of parts is required and consequently, the assembling process is prolonged due to the fact that it is necessary to arrange the heat sinks 17 and the terminal strips individually. Moreover, there has been a drawback that in respect of reliability, such problems as the lack of dielectric strength or the like are liable to arise from breakage of the insulating film 15 or the like.

Furthermore, in the assembling method as described with reference to FIGS. 3*a*, 3*b* and 4*a*, 4*b*, although the problems as described above can be generally settled, since large amount of pressure is required when the inner assembly having the positive temperature coefficient thermistor element 12*b* sandwiched between a pair of terminal strips 18 is to be forcibly inserted into the opening 19 of the cylindrical case 14*b*, such problems as deformation of the terminal strips 18, damage to the thermistor element 12*b* or the like are frequently invovled. There has occasionally been an extreme case wherein the cylndrical case 14*b* is damaged when the inner assembly is inserted thereinto and it has been difficult to achieve a desirable work, since the inner assembly has a necessity to be forcibly inserted into the cylndrical case 14*b*. In addition, the temperature has occasionally varied on the surface of the cylindrical case 14*b*, since an extremely thin air layer is produced between the cylindrical case 14*b* and the terminal strips 18 by a deflection of an inside surface of the opening 19 of the cylndrical case 14*b*, which deflection is caused by the forced insertion of the inner assembly into the cylindrical case 14*b*.

SUMMARY OF THE INVENTION

Accordingly, an important object of the present invention is to provide an improved method of assembling the cylindrical heater whereby various problems caused by the insertion of the inner assembly into the cylindrical case can be completely eliminated.

Another important object of the present invention is to provide an improved method of assembling the cylindrical heater whereby the cylindrical heater can be assembled at reduced cost owing to its simplified assembling work.

A further object of the preent invention is to provide an improved method of assembling the cylindrical heater whereby the cylindrical heater having stable quality and stabilized in surface temperature can be obtained.

In accomplishing these and other objects according to one preferred embodiment of the present invention, there is provided a method of assembling the cylndrical heater, wherein the positive temperature coefficient thermistor element sandwiched between a pair of terminals at its opposite electrode surfaces is inserted into the opening formed in the cylindrical case of a material having heat-shrinkability and thereafter, the cylindrical case is caused to shrink by heating, for holding the positive temperature coefficient thermistor element and the terminal strips under pressure so as to obtain thermal connection thereof.

BREIF DESCRIPTION OF THE DRAWINGS

These and other objects and features of the present invention will become apparent from the following description of preferred embodiments thereof with reference to the accompanying drawings, in which:

FIG. 1 is a perspective view of an example of a conventional cylndrical heater;

FIG. 2*a* is a longitudinal sectional view of another example of a conventional cylndrical heater;

FIG. 2*b* is a cross section taken along the line IIb—IIb in FIG. 2*a;*

FIGS. 3*a* and 3*b* are respectively a longitudinal sectional view and a side view of a further example of a conventional cylindrical heater;

FIG. 4*a* is a cross sectional view of a cylindrical case of the cylindrical heater in FIGS. 3*a* and 3*b;*

FIG. 4*b* is a cross sectional view of an inner assembly of the cylindrical heater in FIGS. 3*a* and 3*b;*

FIG. 5*a* is a longitudinal sectional view of a cylindrical heater according to one preferred embodiment of the present invention;

FIG. 5*b* is a cross section taken along the line Vb—Vb in FIG. 5*a;*

FIG. 6*a* is a longitudinal sectinal view of a cylindrical heater according to another embodiment of the present invention;

FIG. 6*b* is a cross section taken along the line VIb—VIb in FIG. 6*a;*

FIGS. 7*a* and 7*b* are cross sections of the cylindrical case in FIGS. 5*a* and 5*b,* and in FIGS. 6*a* and 6*b,* respectively;

FIGS. 8*a* and 8*b* are fragmentary perspective views of the terminal strips in FIGS; 5*a* and 5*b,* and in FIGS. 6*a* and 6*b,* respectively;

FIGS. 9*a* and 9*b* are perspective view of the positive temperature coefficient thermister elements in FIGS; 5*a* and 5*b,* and in FIGS. 6*a* and 6*b,* respectively; and FIGS. 10*a* and 10*b* are cross sectional views of the inner assemblies in FIGS. 5*a* and 5*b,* and in FIGS. 6*a* and 6*b* respectively.

DETAILED DESCRIPTION OF PREFERRED EMBODIMENTS OF THE INVENTION

Figure 1:
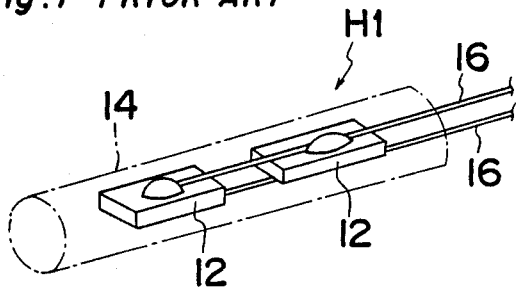
Fig.1 PRIOR ART
Figure 2A:
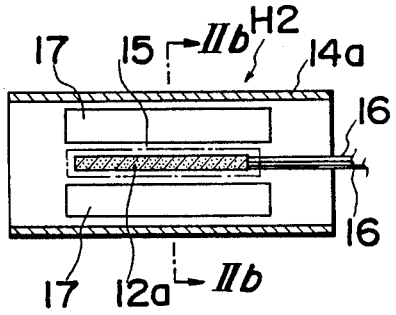
Fig.2a PRIOR ART
Figure 2B:
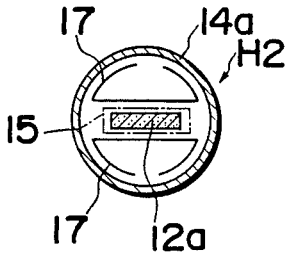
Fig.2b PRIOR ART
Figure 3B:
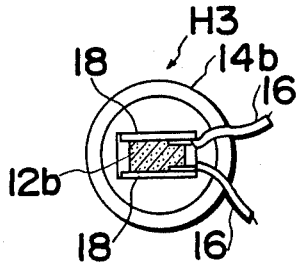
Fig.3b PRIOR ART
Figure 3A:
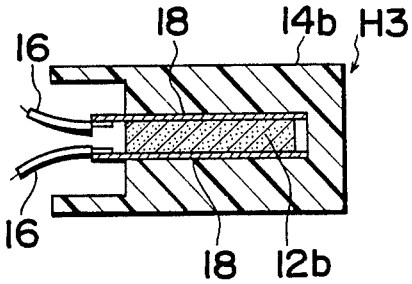
Fig.3a PRIOR ART
Figure 4A:
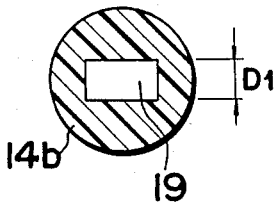
Fig.4a PRIOR ART
Figure 4B:
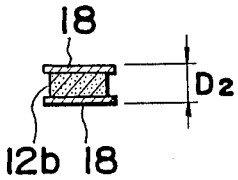
Fig.4b PRIOR ART

Before the description of the present invention proceeds, it is to be noted that like parts are designated by like reference numerals throughout the accompanying drawings.

Figure 5A:
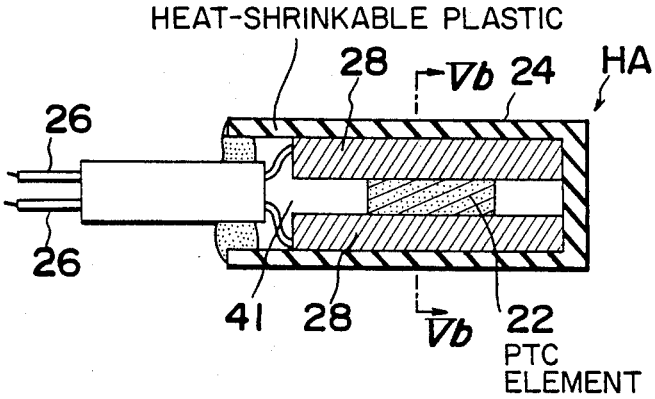
Figure 5B:
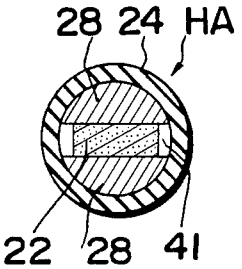
Figure 6A:
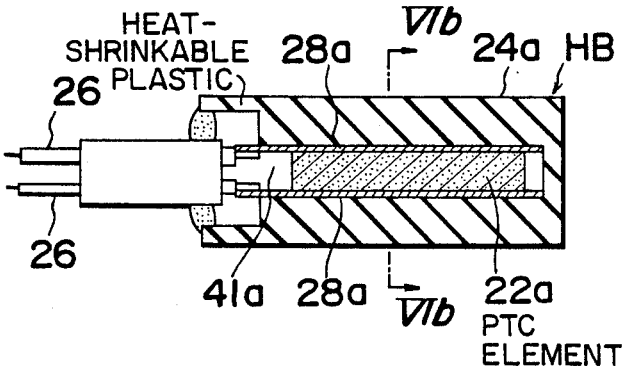
Figure 6B:
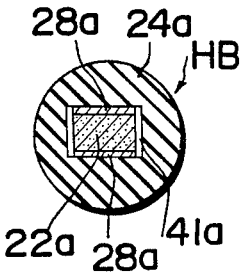

Referring now to the drawings, there is shown in FIGS. 5*a* and 5*b,* one preferred embodiment of a cylindrical heater HA provided with a cylindrical case 24 which has a circular opening 41 formed therein. In FIGS. 6*a* and 6*b,* there is also shown another embodiment of the cylindrical heater HB having a rectangular opening 41*a* formed in the cylindrical case 24*a* thereof.

An assembling method for the cylindrical heater HA or HB as described above will be explained hereinafter.

Figure 10A:
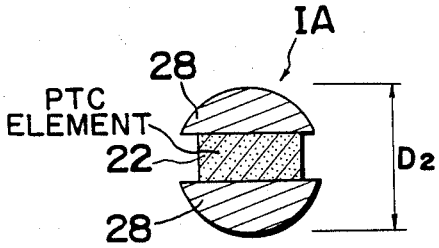
Figure 10B:
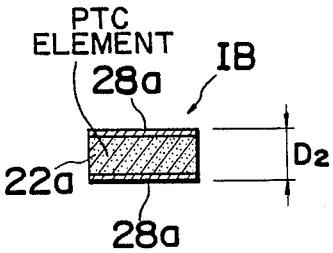

Firstly, an inner assembly IA or IB of the cylindrical heater HA or HB can be obtained wherein a positive temperature coefficient thermistor element 22 of 22*a* having its opposite electrocde surfaces thereon, is held between separate, for example, a pair of terminal strips 28 or 28*a.* That is, there is shown in FIGS. 10*a* an example of the inner assembly IA of the cylindrical heater HA wherein the positive temperature coefficient thermistor element 22 shaped like a disc is sandwiched between a pair of terminal strips 28, each of which has a semi-circular cross section, and there is also illustrated in FIG. 10*b* another example of the inner assembly IB of the cylindrical heater HB wherein the positive temperature coefficient thermistor element 22 which is like a rectangular solid in shape is held between a pair of terminal strips 28*a,* each of which has a shape like a rectangular flat plate. In the above described examples, a total thickness of the inner assembly IA or IB is made D2 in dimension.

It is to be noted here that the positive temperature coefficient thermistor element 22 or 22*a* and the terminal strips 28 or 28*a* are not limited in shape, but in addition, a variety of combintios thereof can be freely selected. The terminal strips 28 or 28*a* should be preferably made of a material having superior electrical and thermal conductivity, such as aluminum, brass or the like, and should be desirably connected with a pair of lead wires 26 in advance.

Figure 7A:
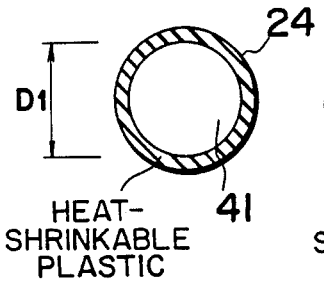
Figure 7B:
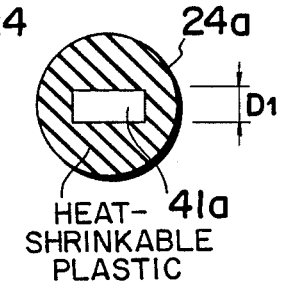
Figure 8A:
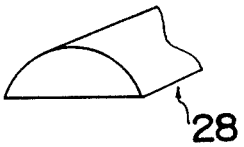
Figure 8B:
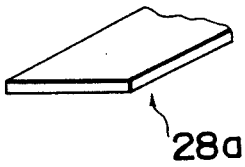
Figure 9A:
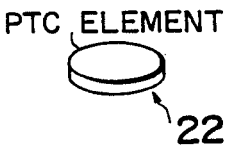
Figure 9B:
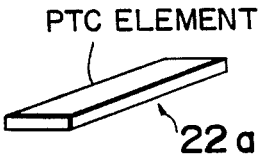

In a further step, the inner assembly IA or IB prepared in the manner as described above is inserted into the opening 41 or 41*a* of the cylindrical case 24 or 24*a* having a bottom as illustrated in FIGS. 7*a* and 7*b.* At this moment, note that it is preferable to insert the inner assembly IA having a circular cross section as shown in FIG. 10*a,* into the cylindrical case 24 with the circular opening 41 as shown in FIG. 7*a.* Likewise, it is also preferable to insert the inner assembly IB having a rectangular cross section as shown in FIG. 10*b,* into the cylndrical case 24*a* withthe rectangular opening 41*a* as shown in FIG. 7*b.* Nevertheless, cylndrical cases having openings different in shape from the above described ones in cross section may also be adoptable. In other words, the inner assembly having a cross section differnt from that of the opening of the cylindrical case can be adopted. Then, on the assumption that D2 is adopted as an inside diameter or inner short side length of the opening 41 or 41*a* before the inner assembly IA or IB is inserted thereinto, and given that D1 is greater than or equal to D2, it is not necessary to forcibly insert the inner assembly IA or IB into the opening 41 or 41*a,* respectively. It is necessary to adopt the cylindrical case 24 or 24*a* of a material with heat-shrinkability and furthermore, it is desirable to select the above described cylindrical case 24 or 24*a* of a material having superior electrical insulating characteristics and thermal conductivity, for example, a material such as shrinkable silicone rubber or the like filled with a filler of SiO2 Al2O3, MgO, etc..

Thereafter, the cylindrical case 24 or 24*a,* actually the whole cylndrical heater including the cylindrical case 24 or 24*a,* is shrunk wholly by being heated, for example, at a temperature of approximately 180°-250° C. for about 1-12 hours to turn the above described connection of D1 and D2 into a connection in which D1 is smaller than D2 (D1 is equal to D2 in shape) and as a result, the positive temperature coefficient thermistor element 22 or 22*a* and the terminal strips 28 or 28*a* are closely contacted with each other as well as the terminal strips 28 or 28*a* and the cylindrical case 24 or 24*a*. In the cylindrical heater HA or HB assembled in the above described manner, the positive temperature coefficient thermistor element 22 or 22*a* and the terminal strips 28 or 28*a* are ensured in electrical and thermal contact thereof under the influence of elasticity of the cylndrical case 24 or 24*a* after heating and ensuring shrinkage thereof, and the terminal strips 28 or 28*a* and the cylindrical case 24 or 24*a* are also ensured in thermal contact thereof.

Thus, each of the cylindrical heaters HA or HB as shown in FIGS. 5*a*, 5*b* and 6*a*, 6*b* can be obtained. In the assembling method described so far, it is not necessary to forcibly insert the inner assembly IA or IB having a construction wherein the positive temperature coefficient thermistor element 22 or 22*a* is sandwiched between the pair of the terminal strips 28 or 28*a* into the cylndrical case 24 or 24*a*. Thus, the inner assemby IA or IB can be unforicbly and quickly inserted into the cylindrical case 24 or 24*a*, so the cylindrical heater HA or HB can be assembled at reduced cost owing to its simplified assembling work. Accordingly, since the terminal strips 28 or 28*a* and the positive temperature coefficient thermistor element 22 or 22*a* never receive immoderate force, deformation and damage which might produce such an inferiority as deterioration of a dielectric strength level is desirably avoided to either the inner assembly IA or IB, or the cylindrical case 24 or 24*a*. Furthermore, it can be also avoided to generate uneven surface temperature of the cylndrical heater which is caused by an extremely thin air layer produced by a deflection on an inside surface of the cylindrical case 24 or 24*a*, with the deflection being caused by the forced insertion of the inner assembly IA or IB into the cylindrical case 24 or 24*a*.

In addition, it is possible to obtain the cylindrical heater Ha or HB having stable quality, and stablizied in surface temperature, since it is capable of ensuring close contact among the positive temperature coefficient thermistor element 22 or 22*a*, the terminal strips 28 or 28*a* and the cylindrical case 24 or 24*a* due to the fact that the cylindrical case 24 or 24*a* is treated by heating after the positive temperature coefficient thermistor element 22 or 22*a* held between a pair of terminal strips 28 or 28*a* has been inserted thereinto.

Meanwhile, it may be so modified that a silicone rubber of heat curing type in general use is employed for the cylndrical case 24 or 24*a* and the heating and subsequent shrinking process for the cylindrical case 24 or 24*a* after the insertion of the inner assembly IA or IB thereinto is combined with the second curing process for the above mentioned silicone rubber, with the connection in which the inside diameter or inner short side length D1 of the opening 41 or 41*a* of the cylindrical case 24 or 24*a* is greater than or equal to the total thickness D2 of the inner assembly IA or IB, being satisfied in a process prior to the second curing process for the silicone rubber which is generally crried out. This means that in molded products composed of the silicone rubber of heat curing type in general use, it is advantageously utilized that the above mentioned molded products have such aproperty as the products shrink through the second curing process, relative to those prior to the second curing process. According to the above described manner, the assembling process for the cylndrical heater can be economically simplified, since it is not necessary to provide the heating and subsequent shrinking process for the cylindrical case 24 or 24 separately.

Although embodiments of the present invention have been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method of assembling a cylindrical heater, which comprises the steps of:

holding a positive temperature coefficient thermistor element between a pair of terminal members at its opposite electrode surfaces to prepare an inner assembly of said cylindrical heater;

inserting said inner assembly into the open end of a cylndrical case having one open end and one closed end, said cylindrical case being made of a material having heat-shrinkability; an inner dimension of said open end of said case being greater than a corresponding outer dimension of said inner assembly, thereby permitting unobstructed insertion of said inner assembly into said case; and heating said cylindrical case and continuing the heating to subsequently to shrink said case and thereby hold said positive temperature coefficient thermistor element and said therminal members under pressure so as to obtain thermal connection thereof, said case thereby permitting thermal conduction, but blocking substantial air flow, between said terminal members and the exterior of said case;

wherein a silicone rubber of heat curing type is employed for said cylindrical case and the heating and subsequent shrinking processes for said cylindrical case are combined with a heat curing process for said silicone rubber.

2. A method of assembling a heater to have a predetermined outer shape, comprising the steps of:

providing a pair of terminal members having inner surfaces, and having outer surfaces which define said predetermined outer shape;

holding a positive temperature coefficient thermistor element between said inner surfaces of sad pair of terminal members to prepare an inner assembly of said heater;

providing a case made of heat-shrinkable material and having one open end and one closed end, an inner dimension of said open end of said case being greater than a corresponding outer dimension of said inner assembly, thereby permitting unobstructed insertion of said inner assembly into said case;

inserting said inner assembly into said open end of said case; and heating and continuing to heat; thereby subsequently shrinking said case to seal the same and hold said thermistor and said terminal members under pressure and thereby obtain thermal and electrical connection thereof, said case thereby permitting thermal conduction, but blocking substantial air flow, between said terminal members and the exterior of said case;

wherein a silicone rubber of heat curing type is employed for said cylindrical case and the heating and subsequent shrinking processes for said cylindrical case are combined with a heat curing process for said silicone rubber.

3. A method as in claim 2, wherein said predetermined outer shape is cylindrical, said pair of terminal members having outer surfaces which define said cylindrical outer shape, and said open end of said case being sized to permit unobstructed insertion of said terminal members and thermistor.

4. A method as in claim 2, including providing terminal members having excellent thermal conductivity such that substantial heat from said thermistor element is radiated outside said sealed case, without substantial convection or air flow closely adjacent to said thermistor element or said terminal members within said case.

5. A method as in claim 4, wherein substantially solid terminal members are provided.

* * * * *